US005442900A

United States Patent [19]

Ciampi

[11] Patent Number: 5,442,900

[45] Date of Patent: Aug. 22, 1995

[54] HORSE TRAINING DEVICE

[76] Inventor: Joan Ciampi, P.O. Box 11214, Greenwich, Conn. 06831-1214

[21] Appl. No.: 174,242

[22] Filed: Dec. 28, 1993

[51] Int. Cl.[6] ..... B68B 1/00

[52] U.S. Cl. ..... 54/71; 54/36

[58] Field of Search ..... 54/16, 36, 52, 71

[56] References Cited

U.S. PATENT DOCUMENTS

| | | | |
|---|---|---|---|
| 50,822 | 11/1865 | Hartman | 54/36 X |
| 424,258 | 3/1890 | Belknap | 54/36 X |
| 477,560 | 6/1892 | Lee | 54/52 |
| 4,293,125 | 10/1981 | Hinds | 482/82 |
| 4,492,073 | 1/1985 | Finke | 54/35 |
| 5,094,062 | 3/1992 | Clark | 54/71 |
| 5,148,656 | 9/1992 | Meaghan | 54/36 |

*Primary Examiner*—Robert P. Swiatek

*Attorney, Agent, or Firm*—St. Onge Steward Johnston & Reens

[57] ABSTRACT

A horse training device for encouraging straight line movement in a horse, for use with a bridle and a bit, and a set of reins attachable to the bridle to form a loop, the loop having a first side and a second side. The horse training device includes at least one substantially rigid tubular member, but most preferably includes two tubular members. One tubular member extends at least partially about the first side of the reins and another tubular member extends at least partially about the second side of the reins. The tubular members maintain substantially uniform pressure along a portion of the neck of the horse and restrict movement of the reins. A positioner is located between each tubular member and the bit and positions each tubular member at a predetermined location along the reins so as to prevent undesired travel of the tubular members toward the bit. Most preferably, end pieces are attached at each end of the tubular members to ensure that the tubular member does not undesirably rub against the horse.

15 Claims, 2 Drawing Sheets

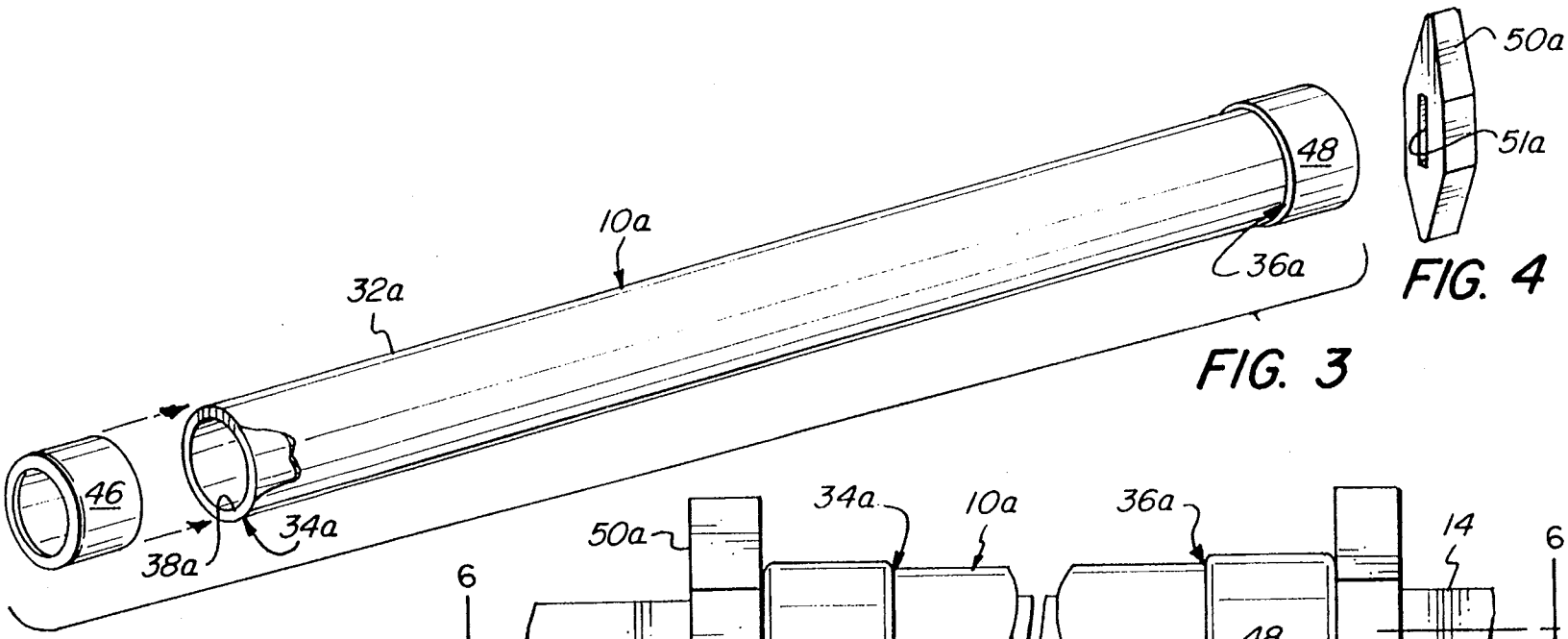
FIG. 3
FIG. 4
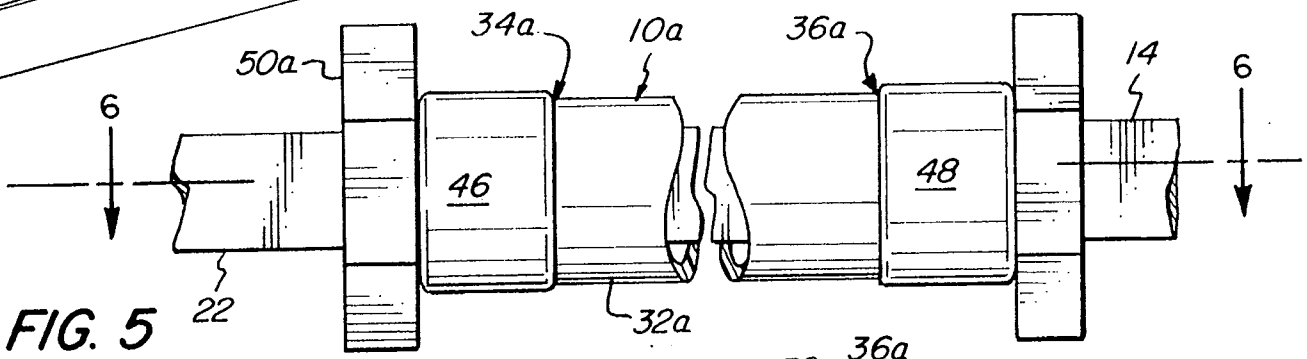
FIG. 5
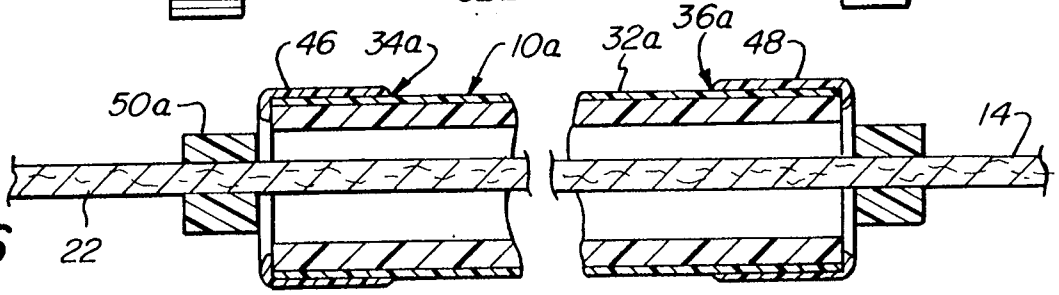
FIG. 6

HORSE TRAINING DEVICE

FIELD OF THE INVENTION

The present invention relates generally to horse riding and training devices, and more particularly to horse riding devices which encourage a horse to travel in a straight line.

BACKGROUND OF THE INVENTION

Horse training devices which facilitate the training of horses to perform desired tasks are known. Few devices, however, address one of the most common problems associated with horse riding, which is maintaining horse movement in a substantially straight line at all desired times. When a horse, especially a show horse, fails to travel in a straight line, it detracts from the overall performance of the horse and can cause points to be deducted from the score. In addition, when a horse used for jumping fails to travel in a straight line, especially when jumping between two closely located objects, it can result in poor placement before the jump. As a result, the horse can trip over or brush against the objects and fall. This, not surprisingly, can cause injury to the horse and its rider. In addition, brushing a fence can knock it down, resulting in a loss of points during an equestrian competition.

Furthermore, it is known that when horses turn corners, their shoulders tend to drop in or bulge out, sometimes causing the hind quarters of the horse to "fall out" or "fish tail". As such, the horse is somewhat unbalanced while turning.

One training device disclosed in U.S. Pat. No. 4,492,073 to Finke improves a horse's ability to set its head which improves a horse's ability to travel in a straight line. Finke discloses a bitting rig apparatus which includes an elongated, flexible member which is releasably attached at its ends to a saddle. A ring is slideably positioned on the first member. A second elongated, flexible member extends through the ring and is releasably attached to opposite ends of the bit. While this device teaches a horse to hold its head still, it is disadvantageous in that it almost completely prevents the horse from turning its head from side to side. As such, it is virtually impossible for a horse to make a turn. Moreover, because of the horse's inability to move laterally, the device is generally used only by horses while they are in the stall; consequently, it is not capable of teaching a horse not to drop its shoulder in or out while making a turn.

Applicant is also aware of another device which is used to encourage horses to travel in a straight line. This device includes two heavy metal strips which attach to the bit, and which extend adjacent to each side of the horse's neck. The reins pass through a hole in the strips at the end opposite the bit so as to maintain the position of the strips adjacent to the reins. These metal strips have several drawbacks. First, the device is ineffective in preventing a horse from dropping its shoulder in or out while making a turn. Second, the strips are heavy and hard to maneuver. Third, the strips are uncomfortable to the horse because they are so long; that is, the strips tend to jab the horse in the nose, mouth and shoulder. Fourth, the length and weight of strips prevents the horse from turning easily. Finally, because the horse tends to be uncooperative when these devices are attached to the reins, they are generally used by experienced riders.

What is desired, therefore, is a horse training device which encourages a horse to travel in a straight line, which teaches a horse not to drop its shoulder while making a turn, which does not interfere with the horse's natural movements, and which can be used while a rider rides a horse, which can be used by a rider of any level of experience, and which is quick and easy to install, and light-weight.

SUMMARY OF THE INVENTION

Accordingly, it is an object of the present invention to provide a horse training device that encourages a horse to travel in a straight line.

It is another object of the present invention to provide a horse training device that encourages a horse not to drop its shoulder in or out while making a turn and which encourages the horse to make a balanced turn.

It is yet another object of the present invention to provide a horse training device that does not interfere with the natural movements of the horse.

It is still another object of the present invention to provide a training device that can be used while riding a horse.

It is a further object of the present invention to provide a horse training device that can be used by a rider of any level of experience.

It is yet a further object of the present invention to provide a horse training device that is quick and easy to install, remove and use.

It is still a further object of the present invention to provide a horse training device that can be used with horses of all sizes, as well as ponies and colts.

To overcome the deficiencies of the prior art and to achieve the objects listed above, a horse training device or movement guiding device is disclosed for guiding a horse in a substantially straight line and for encouraging a horse not to drop its shoulder in or out while making a turn. The device is usable with a bridle and a bit, and a pair of reins attachable to the bit, the reins having a first and second side. In its preferred embodiment, the device comprises a tubular member having two ends and a channel extending therebetween. Preferably, one tubular member extends about the first side of the reins, and another tubular member extends about the second side of the reins. As such, the tubular guide members apply a substantially constant and uniform pressure along at least a portion of the horse's neck adjacent to the tubular members.

At least one positioner, preferably a rubber stopper, is positioned along the first and second side of reins at a predetermined location between the bit and each tubular guide member and positions the guide member, where desired, along the reins. As such, the positioner prevents undesired travel of the guide member towards the bit. If desired, one positioner could be placed on both ends of the guide member to more adequately ensure proper placement of the guide member and to more fully prevent undesired movement of the guide member.

The invention and its particular features and advantages will become more apparent from the following detailed description when considered with reference to the accompanying drawings.

BRIEF DESCRIPTION OF THE DRAWINGS

FIG. 3 is a side view of the horse guiding device, shown in FIG. 1, with portions broken away, and with an end piece detached;

FIG. 4 is an isometric view of a positioner shown in FIG. 1;

FIG. 5 is a side view of the horse guiding device with portions broken away; and FIG. 6 is a cross sectional view of the device shown in FIG. 5 taken along line 6—6.

DETAILED DESCRIPTION OF THE DRAWINGS

Figure 1:
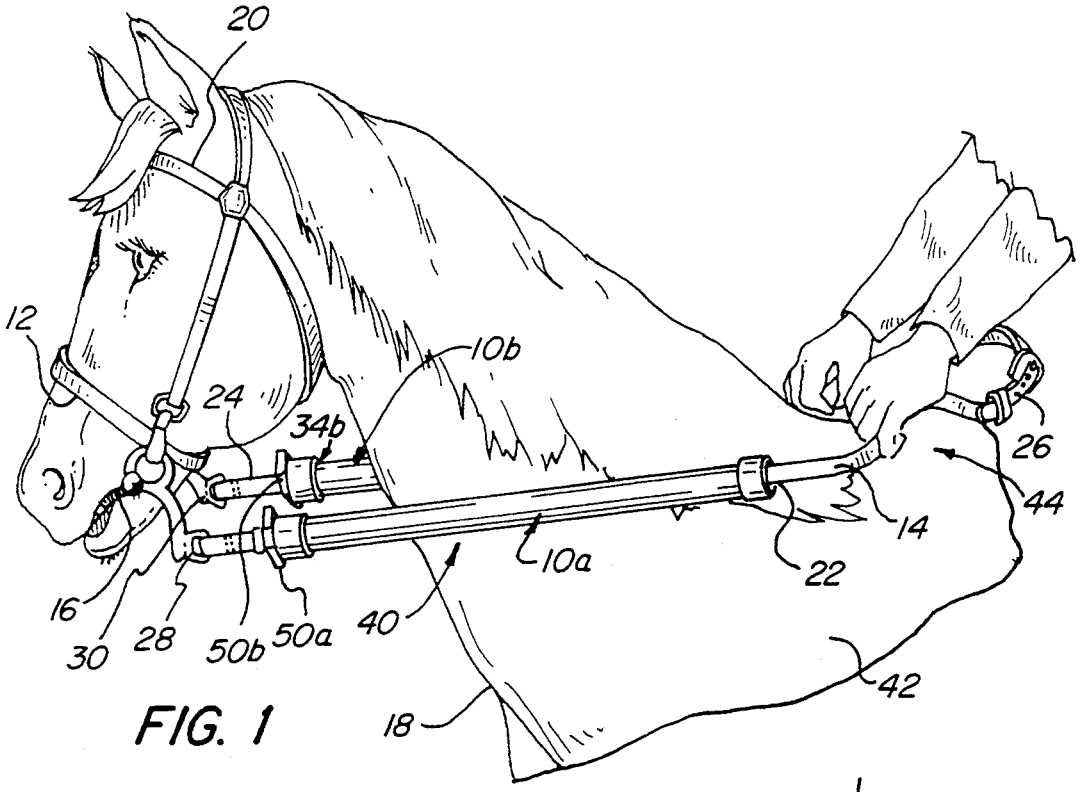
FIG. 1 is a side view of a horse guiding device, constructed in accordance with the present invention, installed about the reins of a horse.

Referring to the drawings in detail, a horse training device is shown and generally designated by the reference numerals 10*a*, 10*b*. It should be understood that horse training devices 10*a*, 10*b* are identical. As such, references or descriptions to only one device are generally applicable to the other.

Figure 2:
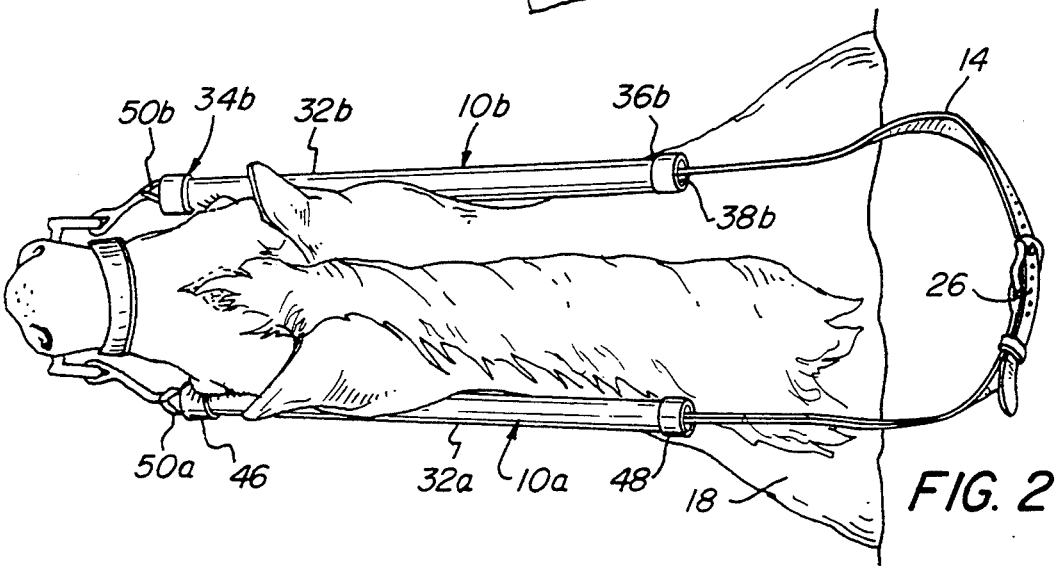
FIG. 2 is a top view of the horse guiding device shown in FIG. 1.

As best shown in FIGS. 1, 2, horse training devices 10*a*, 10*b* can be used with a conventional bridle 12 having reins 14 and bit 16. Bridle 12, which can be made from any suitable material, is preferably made of strap-like leather, and is generally secured to horse 18 by head stall 20.

As shown in FIG. 1, reins 14 include first side 22 and second side 24 and are adjustable in length by any suitable means, such as a belt buckle and hole arrangement 26. Reins 14, which can be made of any suitable material, are most preferably made of leather, and are attached to bit 16 at ends 28, 30 of each side 22, 24, respectively. Reins 14 can be attached to bit 16 in any suitable manner, such as by conventional hook studs (not shown).

As best shown in FIGS. 3, 5–6, horse training or guiding device, for example, 10*a*, in its preferred embodiment comprises at least one tubular member 32*a* having two open ends 34*a*, 36*a* and channel 38*a* (FIG. 3) extending therebetween. Most preferably the device 10 comprises an additional guide member 32*b* having open ends 34*b*, 36*b* and channel 38*b* extending therebetween. One guide 10*a* is located on, and positionable about, first side 22 of reins 14 and one guide 10*b* is located on, and positionable about, second side 24 of reins 14. See FIGS. 1, 2. Each member 32*a*, 32*b* extends at least partially about and substantially encloses at least a portion of one of the sides 22, 24 of reins 14, as shown in FIGS. 1, 2, 5, 6, and prevents undesired movement of at least the enclosed portion of reins 14. Guiding devices 10*a*, 10*b* maintain substantially uniform pressure along at least a portion of neck 40 of horse 18 adjacent to tubular members 32*a*, 32*b* and guide, direct and/or encourage horse 18 to travel in a substantially straight line.

It should be understood that guiding devices 10a, 10b can take on any shape, size or form sufficient to provide and maintain substantially uniform pressure along at least a portion of neck 40 of horse 18. Although the tubular-shaped member 32*a*, 32*b* is preferred, other suitable means include, but are not limited to, a u-shaped member, wherein neck 40 is positioned inside the u-shaped member.

Tubular member 32*a*, 32*b* can be made of any material which is heavy enough to provide a constant and sufficient force against neck 40 to direct and guide horse 18 to travel in a substantially straight line, but should not be so heavy so as to be unduly uncomfortable to the horse or so as to interfere with the natural movements of the horse. Suitable materials, include, but are not limited to, plastics, and most preferably polyvinyl chloride (PVC).

As shown in FIG. 1, horse guiding device, for example, 10*a*, can be made any suitable length, but most preferably spans from about bit 16 to at least a portion of one shoulder 42, substantially spanning neck 40 of horse 18 to approximately the location of the withers 44. In usage, the actual length of device 10*a* will depend the size of the horse or pony. For example, a full-grown horse or pony may require a longer device 10*a* than a colt. In the preferred embodiment, the length of device 10*a* used for a horse is approximately eighteen to about thirty inches long, but most preferably about twenty to twenty-eight inches long. The length of device 10*a* for a pony is approximately twelve to about twenty inches, but most preferably approximately fourteen to eighteen inches.

The inner diameter of tube 32*a* can be any suitable diameter which is sufficiently large to allow reins 14 to be inserted into tube 32*a*, but not so large that tube 32*a* bounces around undesirably while horse 18 moves. Preferably, tube 32*a*, when used on a horse has an inner diameter of about 0.5" to about 15", and is most preferably about 1"; an appropriate outer diameter for member 32*a* is about 0.75" to about 1.75" and is most preferably about 1.25".

As shown in FIGS. 2–3, 5–6, horse training device 10*a* includes end pieces 46, 48, each end piece 46, 48 being removably attachable to ends 34*a*, 36*a* of tubular member 32*a*. End pieces 46, 48 are preferably made of any suitable light weight material, such as rubber or plastic, and generally provide a smooth pipe outer surface so that any sharp edges of tube 32*a* do not rub against the horse or injure a person handling the device 10*a*.

Positioners 50*a*, 50*b* position horse guiding devices 10*a*, 10*b* at predetermined locations along reins 14 so as to prevent undesired travel of devices 10*a*, 10*b* along reins 14, as shown in FIGS. 1, 2, 4. In usage, either one or two positioners could be used to position each device 10*a*, 10*b*. Most preferably, at least one positioner, such as 50*a* is located between tubular member 32*a* and bit 16, as shown in FIG. 1; positioner 50*b* positions member 32*b* along the second side 24 of reins 14. Due to gravity and the general position of reins 14 during riding, tubular member 32*a* is generally in contact with positioner 50*a* during the course of the ride. If desired, two positioners could be used with one tubular member, wherein one positioner is located at each end 34*a*, 36*a* of tubular member 32*a*, to further ensure that undesired travel of device 10*a* is prevented.

Positioners 50*a*, 50*b* can be made of any suitable material, but are most preferably made of rubber. Positioners, such as 50*a*, are shown as a separate piece distinct from device 10*a*. However, it should be understood that positioners 50*a*, 50*b* could be incorporated into, and as part of, device 10*a*, 10*b* so long as one's ability to install device 10*a*, 10*b* about reins 14 is not substantially interfered with.

It should be understood that positioners 50*a*, 50*b* are preferred, but not required, for use. Tubular member 32*a* can be allowed to rest against bit 16, thus eliminating the need for any positioners. If positioners 50*a*, 50*b* were not used, then a corresponding adjustment in the length of members 32*a*, 32*b* would be necessary to ensure that members 32*a*, 32*b* extended substantially to shoulder 42 of horse 18, substantially spanning neck 40.

In operation, bridle 12 and bit 16 are positioned on horse 18 and reins 14 are secured thereto. Reins 14 are unbuckled at 26, if necessary, to install positioners 50*a*, 50*b*. First side 22 of reins 14 is guided through channel 51*a* (FIG. 4) of positioner 50*a*. Positioner 50*a* is then slid down first side 22 until positioner 50*a* is placed desirably near bit 16. Positioner 50*b* is similarly placed on second side 24 of reins 14. First side 22 of reins 14 is inserted into channel 38*a* of tubular member 32*a*. Second side 24 of reins 14 is inserted into a corresponding channel of member 32*b*. Reins 14 are then buckled at 26.

After devices 10*a*, 10*b* are properly positioned on reins 14, devices 10*a*, 10*b* span substantially between bit 16 to shoulder 42, substantially spanning neck 40 of horse 18. Horse 18 can then be ridden as usual. It should be noted that guiding devices 10*a*, 10*b* do not interfere with riding, they do not interfere with the rider, nor do they interfere with the horse's natural movements. Because of the substantially uniform pressure caused by devices 10*a*, 10*b* on shoulder, such as 42, devices 10*a*, 10*b* substantially prevent horse 18 from dropping its shoulder in or out as it turns and encourages horse 18 to travel in a nearly straight line. Furthermore, devices 10*a*, 10*b* encourage horse 18 to make a balanced turn.

After the ride is completed, the reins may be unbuckled at 26. Tubular members 32*a*, 32*b* can then be removed from first and second sides 22, 24 of reins 14. Positioners 50*a*, 50*b* may then be removed. Guiding devices 10*a*, 10*b* can, however, remain on reins 14 after completion of the ride without interfering with the horse 18, if so desired.

Advantageously, guiding devices 10*a*, 10*b* can be retrofitted onto existing reins 14.

Because devices 10*a*, 10*b* are easy to use and do not interfere with the natural movements of horse 18, devices 10*a*, 10*b* can be used by a rider of any level of experience.

Devices 10*a*, 10*b* may be permanently attached, by any suitable means, to reins 14. One suitable means includes, but is not limited to, gluing.

It should be understood by those skilled in the art that obvious modifications can be made without departing from the spirit of the invention. Accordingly, reference should be made primarily to the accompanying claims, rather than the foregoing specification, to determine the scope of the invention.

We claim:

1. A horse guiding device for use with a bridle, the bridle having a bit and reins attached to the bridle to form a loop, the loop having a first side and a second side, the device comprising:

substantially rigid pressure applying means extendable when in use at least partially about at least one of the sides of the reins and capable of spanning substantially along the neck of a horse for maintaining substantially uniform pressure along the portion of the neck of the horse adjacent to the pressure applying means; and a positioner locatable when in use between the bit and the pressure applying means for positioning the pressure applying means at a predetermined location along the side of the reins about which the pressure applying means extends so as to prevent undesired movement of the pressure applying means.

2. The horse guiding device of claim 1, wherein one pressure applying means is extendable when in use at least partially about the first side of the reins and another pressure applying means is extendable when in use at least partially about the second side of the reins.

3. The horse guiding device of claim 1, wherein the pressure applying means comprises at least one tubular member, the at least one tubular member having two ends and a channel extending therebetween, wherein at least a portion of one side of the reins is extendable through the channel.

4. The horse guiding device of claim 3, wherein each tubular member further comprises at least two end pieces, wherein one end piece is attached at each end thereof.

5. A horse training device positioned about a set of reins having a first side and a second side, the device comprising at least one substantially rigid tubular member having two open ends and a channel extending therebetween, at least a portion of one of the sides of the reins extending through the channel such that the at least one tubular member spans along substantially the entire neck of a horse and maintains substantially uniform pressure along substantially the entire neck of the horse adjacent to the at least one tubular member.

6. The horse training device of claim 5, further comprising at least one positioner positioned at one end of the at least one tubular member for positioning the at least one tubular member at a predetermined location along one side of the reins so as to prevent undesired travel of the at least one tubular member.

7. The horse training device of claim 5, wherein a first tubular member is positioned about the first side of the reins and a second tubular member is positioned about the second side of the reins.

8. An apparatus for encouraging straight line movement in a horse, the apparatus positioned about a set of reins having a first side and a second side, the apparatus comprising:

enclosure means, having two open ends, for substantially enclosing at least a portion of one side of the reins so as to prevent undesired movement of the enclosed reins, the enclosure means positioned so as to span an least a portion of the neck of the horse; and at least one positioner located at one end of the enclosure means for positioning the enclosure means at a predetermined location along one side of the reins.

9. The apparatus of claim 8, wherein the enclosure means comprises at least one substantially tubular member, the at least one tubular member having two ends and a channel extending therebetween, wherein at least a portion of one side of the reins extends through the channel.

10. The apparatus of claim 9, wherein the at least one tubular member further comprises at least two end pieces, wherein one end piece is attached at each end thereof.

11. The apparatus of claim 10, wherein the at least one tubular member is made of a substantially rigid material.

12. An apparatus for encouraging straight line movement in a horse, the apparatus positioned about a set of reins having a first side and a second side, the reins attached to the bridle to form a loop, the loop having a first side and a second side, the apparatus comprising at least two tubular guides, each guide having two ends and a channel extending therebetween, one guide extending about and substantially enclosing at least a portion of the first side of the reins and the other guide extending about and substantially enclosing at least a portion of the second side of the reins, each guide being positioned so as to span substantially an entire neck of a horse and so as to apply substantially uniform pressure along substantially the entire neck of the horse adjacent to the guides.

13. The apparatus of claim 12, further comprising at least two positioners located between the bit and each guide for positioning each guide at a predetermined location along the reins.

14. The apparatus of claim 13, wherein each guide further comprises end pieces attache at each end thereof.

15. The apparatus of claim 12, wherein each guide is made of substantially rigid material.

* * * * *